US008226266B2

(12) United States Patent
Chiang

(10) Patent No.: US 8,226,266 B2
(45) Date of Patent: Jul. 24, 2012

(54) LED BULB

(75) Inventor: Kun-Yuan Chiang, Taipei (TW)

(73) Assignee: Liquidleds Lighting Corp., George Town (KY)

( * ) Notice: Subject to any disclaimer, the term of this patent is extended or adjusted under 35 U.S.C. 154(b) by 314 days.

(21) Appl. No.: 12/731,365

(22) Filed: Mar. 25, 2010

(65) Prior Publication Data

US 2010/0253221 A1 Oct. 7, 2010

(30) Foreign Application Priority Data

Apr. 2, 2009 (TW) ..... 98110990 A

(51) Int. Cl.
*F21S 4/00* (2006.01)
*F21V 21/00* (2006.01)

(52) U.S. Cl. ..... 362/249.02; 362/646; 362/800

(58) Field of Classification Search ..... 362/235–237, 362/244, 249.02, 249.06, 646, 650, 800; 313/318.01, 500
See application file for complete search history.

(56) References Cited

U.S. PATENT DOCUMENTS

| | | | | |
|---|---|---|---|---|
| 5,806,965 | A * | 9/1998 | Deese | 362/249.04 |
| 5,924,784 | A * | 7/1999 | Chliwnyj et al. | 362/234 |
| 6,220,722 | B1 * | 4/2001 | Begemann | 362/231 |
| 6,523,978 | B1 * | 2/2003 | Huang | 362/249.04 |
| 6,827,469 | B2 * | 12/2004 | Coushaine et al. | 362/294 |
| 6,844,824 | B2 * | 1/2005 | Vukosic | 340/815.65 |
| 7,086,756 | B2 * | 8/2006 | Maxik | 362/249.04 |
| 7,396,142 | B2 * | 7/2008 | Laizure et al. | 362/240 |
| 7,726,836 | B2 * | 6/2010 | Chen | 362/249.02 |

* cited by examiner

*Primary Examiner* — Alan Cariaso
(74) *Attorney, Agent, or Firm* — Rosenberg, Klein & Lee

(57) ABSTRACT

An LED bulb uses an LED strip suspended between two lead frames of a stem as a light source to provide uniform illumination with wider angles. The lead frames of the stem provide an improved structural stability to the LED strip while maintaining a reliable electrical connection between the components of the stem and the LED strip. The utilization of both top-emitting and side-emitting LEDs on the LED strip further allows lights emitted in directions substantially parallel and perpendicular to the LED strip to cover a wide angle of illumination from the LED bulb.

15 Claims, 8 Drawing Sheets

LED BULB

FIELD OF THE INVENTION

The present invention is related to a light bulb and, more particularly, to a light-emitting diode (LED) bulb that may be used as a replacement light bulb.

BACKGROUND OF THE INVENTION

Conventional incandescent bulbs mostly include a conductive filament, such as a tungsten filament, supported by lead frames which are connected to an external power source via a bulb base to supply electricity to the filament. The filament is rendered incandescent by current flowing therethrough and thus generates light that radiates outward uniformly and extensively. The conventional incandescent bulb, though capable of a wide lighting angle, is disadvantageous because of its high power consumption, high temperature, and short lifetime. By contrast, a light-emitting diode (LED) bulb has a long lifetime, is power saving, produces no wastes that may cause pollution, and is therefore environmentally friendly. Hence, LED bulbs are gradually replacing the conventional incandescent bulbs and are regarded as the new generation lighting devices. However, the limited lighting angle and high production costs of LED bulbs have restricted their applicability in our daily lives.

U.S. Patent Application Publication No. 2005/0254264 discloses an LED bulb which includes a bent circuit board mounted with LEDs thereon, to provide more extensive and uniform illumination in a three-dimensional space by arranging each of the LEDs to have a light-emitting direction perpendicular to the bent circuit board. However, this LED bulb still has its drawbacks such as high production costs, difficult assembly, and a hard-to-control yield. In addition, a wide lighting angle is unattainable if fewer LEDs are used. Moreover, to expose heat radiating ribs, the circuit board cannot enclose the lateral sides and thus, there will be no LEDs at the lateral sides. Consequently, the LED bulb cannot provide effective lateral illumination.

On the other hand, while it is common practice to connect several through-hole LEDs together for multi-angle light emission, the slender pins typical of commercially available through-hole LEDs tend to cause lack of stability and reliability in the resultant mechanical structure. The multi-angle illumination is achieved by bending the pins of LEDs to different directions, and thus the overall structural stability of the finished product will be even lower. The connection between the pins of LEDs may also be problematic. For instance, short circuit and safety hazards may arise from improper arrangement or spacing between the pins when they are electrically conducted.

Taiwan Pat. No. M340562 provides a lighting device which includes top-emitting LEDs mounted on the central region of the top surface of a circuit board to provide illumination to the front side of the circuit board, side-emitting LEDs mounted on the peripheral region of the top surface to provide illumination to the lateral side of the circuit board, and driver circuitry for driving the LEDs is mounted on the bottom surface of the circuit board. Since all the LEDs are disposed on the top surface of the circuit board, they do not provide illumination to the backside of the circuit board. Furthermore, the LEDs and the driver circuitry for driving the LEDs are mounted on the opposite surfaces of the same circuit board, and thus gather heat within a small area. As a result, it is hard to provide effective heat dissipation for the circuit board and the elements mounted thereon, and overheating is likely to occur, thereby shortening the lifetime and impairing the reliability of the lighting device.

Therefore, it is desired an LED bulb which has a wide lighting angle and multiple light-emitting directions, can effectively dissipate heat so as to maintain the lifetime of the LEDs thereof, is reliable in terms of structure and design, and incurs low production costs.

SUMMARY OF THE INVENTION

An object of the present invention is to provide an LED bulb having an increased lighting angle and light-emitting directions.

Another object of the present invention is to provide a highly reliable LED bulb.

Yet another object of the present invention is to provide a low cost LED bulb.

According to the present invention, an LED bulb includes a member joined to or utilized to combine a housing and a bulb base together, a stem having a first lead frame and a second lead frame extending from the stem into a cavity of the housing, and at least one LED strip suspended between the first and second lead frames. The first and second lead frames of the stem are electrically connected to the bulb base and the at least one LED strip, to provide power to the at least one LED strip. Each of the at least one LED strip includes a substrate mounted with top-emitting LEDs and side-emitting LEDs thereon. The top-emitting LEDs have a light-emitting direction substantially perpendicular to the mounting surface of the substrate that they are mounted thereon, and the side-emitting LEDs have a light-emitting direction substantially parallel to the mounting surface of the substrate that they are mounted thereon.

Preferably, the side-emitting LEDs are mounted on the peripheral region of the mounting surface of the substrate that they are mounted thereon, to provide lateral light and thereby increase the lighting angle of the LED bulb, resulting in wide and uniform illumination. In addition, by using the lead frames to support the at least one LED strip, the LED bulb may have higher reliability and less production costs.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
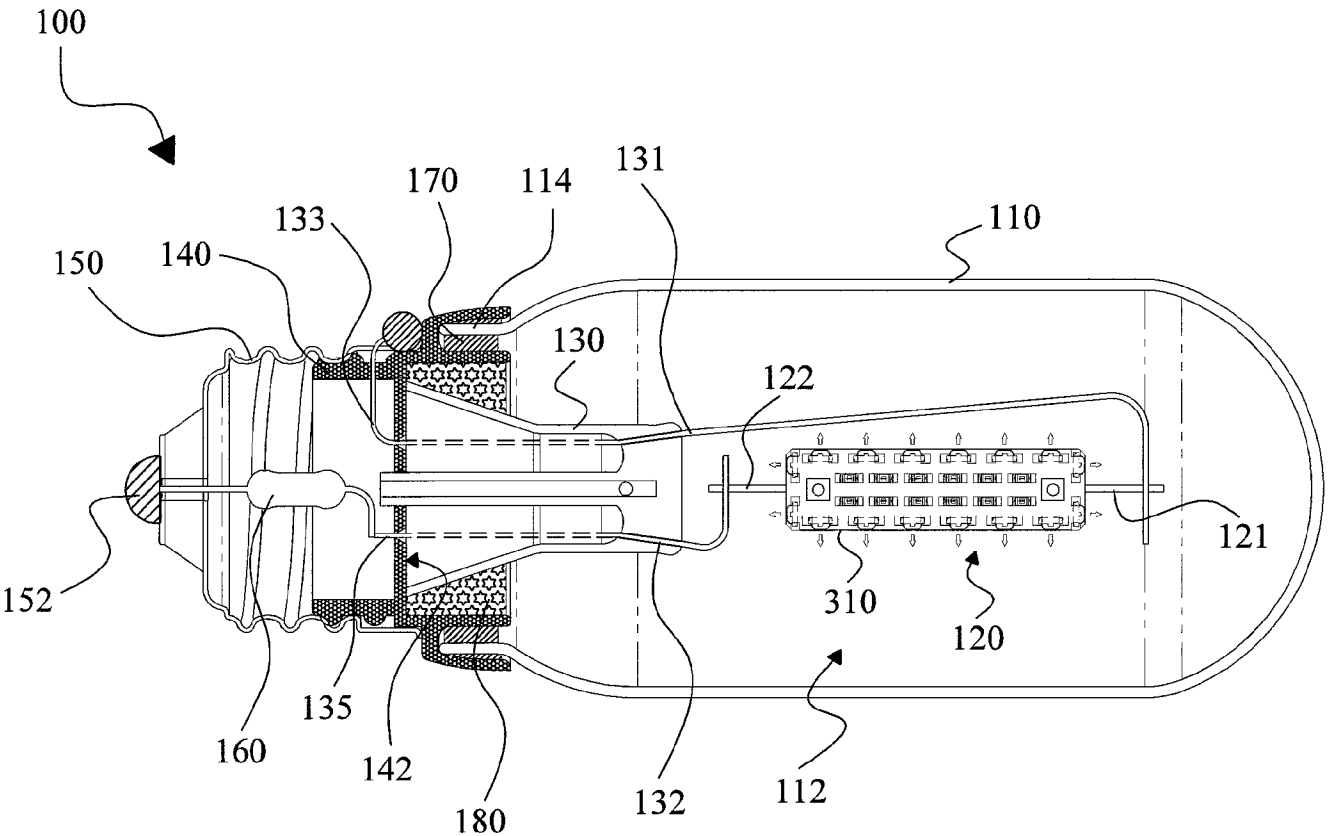
FIG. 1 shows a sectional view taken along the longitudinal axis of the LED bulb according to a first embodiment of the present invention.
Figure 2:
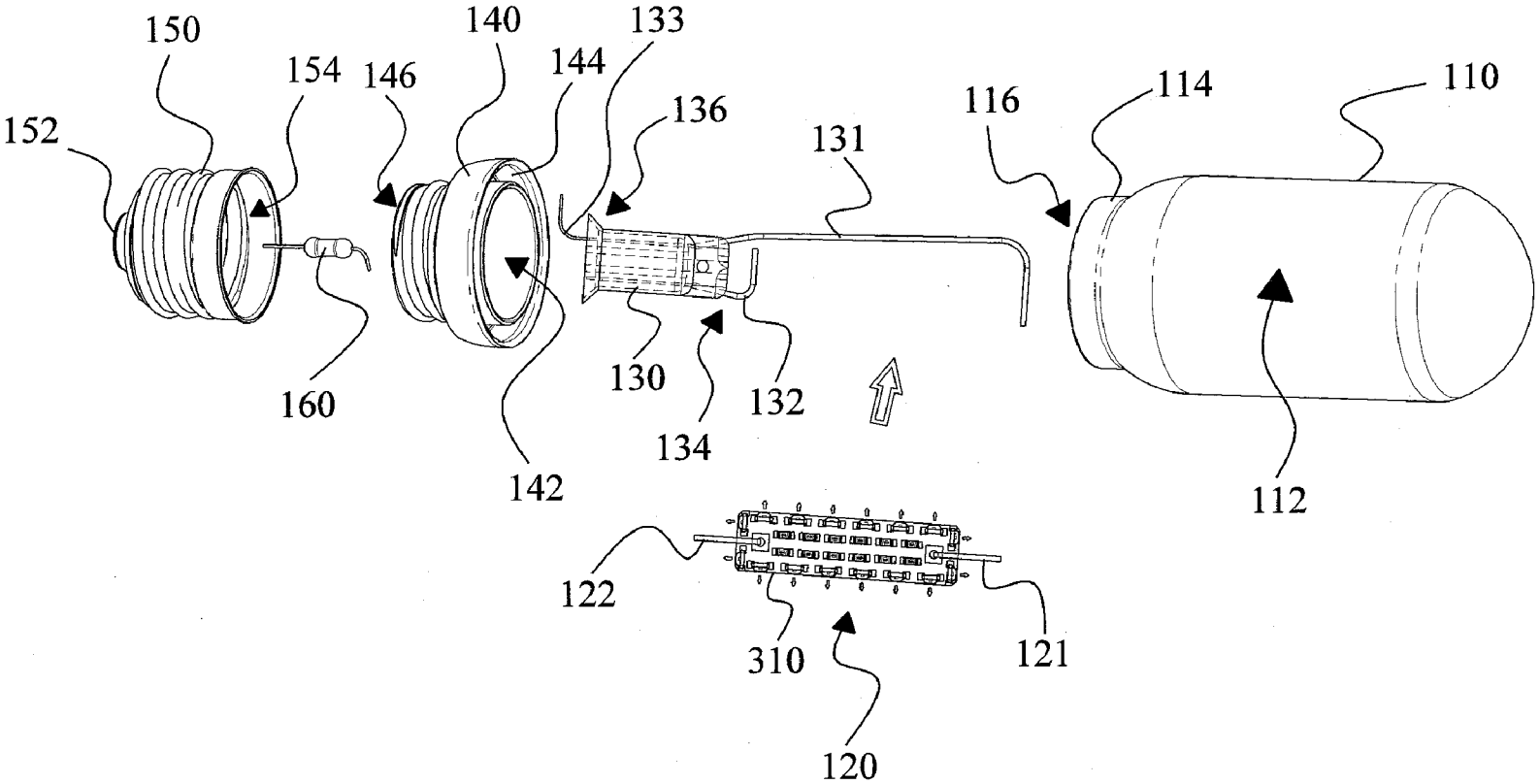
FIG. 2 is an exploded view of the LED bulb as shown in FIG. 1.
Figure 3:
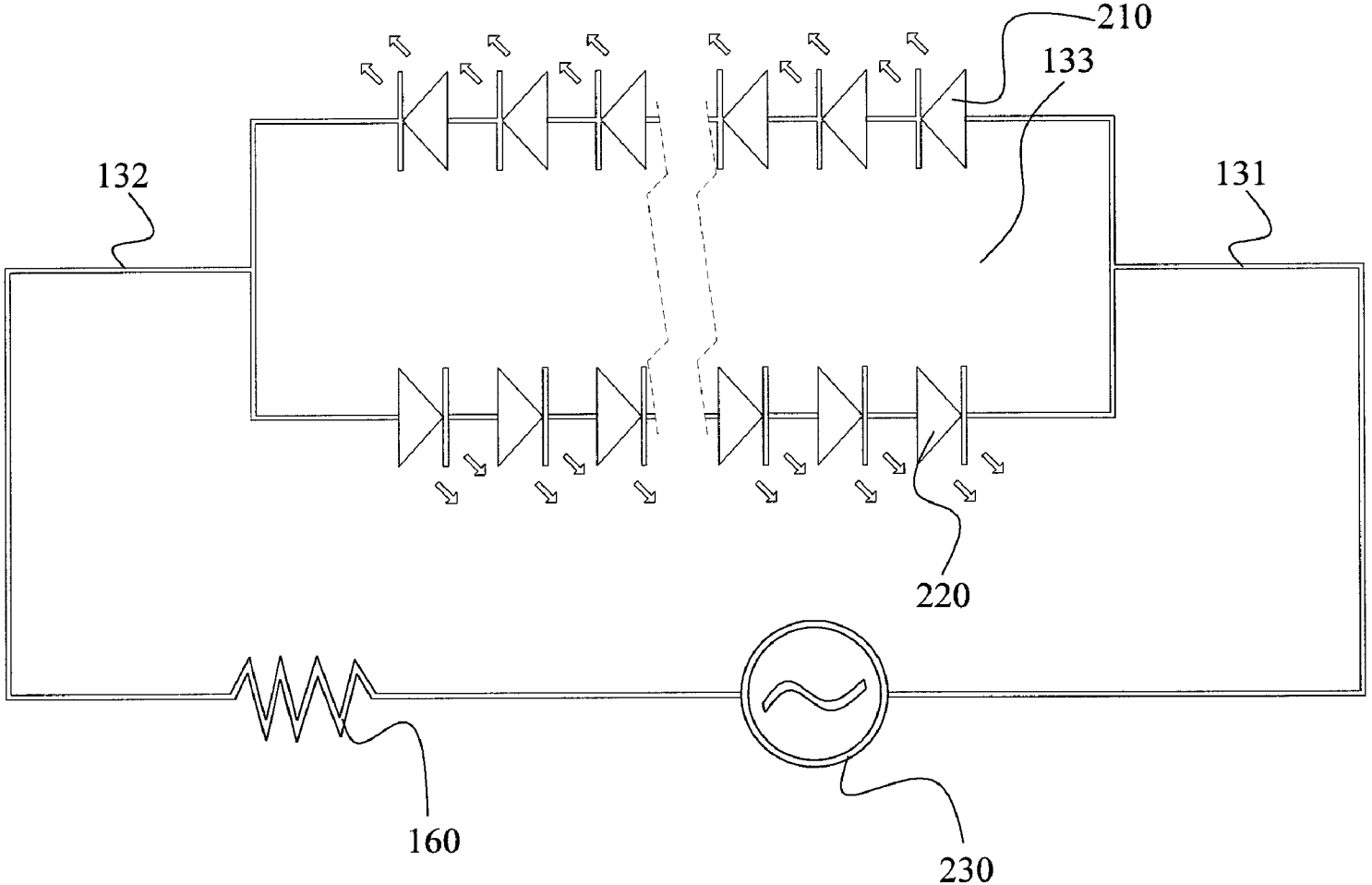
FIG. 3 is an illustrative circuit diagram of the LED bulb as shown in FIG. 1.

FIG. 1 shows an LED bulb 100 according to an embodiment of the present invention; FIGS. 2 and 3 show the exploded view and circuit diagram of the LED bulb 100 of the present invention. The LED bulb 100 includes a housing 110 and a bulb base 150 joined to or combined together by a member 140. In this embodiment, the housing 110 has an end 114 inserting into a groove 144 of the member 140, with a securing medium 170, for example a glue, filled in the groove 144 to secure the housing 110 at the front side of the member 140, and the bulb base 150 is secured at the rear side of the member 140, for example, by means of snug fit or adhesive. As is well known, the bulb base 150 has two electrodes to be connected to an external power source 230, and the housing 110 has a cavity 112 for containing a filament. A stem 130 has lead frames 131 and 132 extending from the front end 134 of the stem 130 into the cavity 112 of the housing 110, and an LED strip 120 is suspended between the lead frames 131 and 132 and has electrodes 121 and 122 electrically connected to the lead frames 131 and 132 respectively. Preferably, the lead frame 131 of the stem 130 extends into the cavity 112 away from the lead frame 132 of the stem 130 at a distance greater than or equal to the length of the substrate 310 of the LED strip 120. In this embodiment, the stem 130 supports the LED strip 120 in the cavity 112 of the housing 110 and supplies power to the LED strip 120 by the electrodes 121 and 122. The housing 110 has an end opening 116 to allow the lead frames 131 and 132 to place into the cavity 112. Through the rear end 136 of the stem 130, the lead frames 131 and 132 are electrically connected to the electrodes of the bulb base 150 by wires 133 and 135 respectively, to deliver power from the external power source 230 through the bulb base 150 and the lead frames 131, 132 to the LED strip 120. Preferably, a power control unit 160 is connected between the electrode 152 of the bulb base 150 and the wire 135, to limit the voltage or power supplied to the LED strip 120. In this embodiment, the stem 130 is secured to the member 140, for example, by applying a securing medium 180, such as glue, between the member 140 and the stem 130, so that the member 140 may support the stem 130. The member 140 has a front-side opening 142 to allow the stem 130 passing therethrough, and a beck-side opening 146 to allow the wires 133 and 135 passing therethrough. The bulb base 150 has a top opening 154 to allow the power control unit 160 and/or the wires 133 and 135 to pass through.

In an embodiment, the power control unit 160 includes a voltage step-down or clamp element, such as a resistor, to control the voltage or power supplied to the LED strip 120 within a predetermined range. It is understood that the power control unit 160 may be dispensed with in another embodiment, depending on the number and power demands of the LEDs mounted on the LED strip 120.

In other embodiments, either or both of the housing 110 and the stem 130 are secured to the member 140 by gluing, thermal fusion, pressing, snug fit, or screw engagement. In some embodiments, the electrodes 121 and 122 of the LED strip 120 are electrically connected to the lead frames 131 and 132 of the stem 130 by soldering, gluing with an electrically conductive adhesive, hook engagement, or winding.

Preferably, each of the lead frames 131 and 132 has a slender shape, for example, in the form of electrically conductive metal wires or rods, so as to be easily adjusted in its dimension to pass through the end openings of different apertures and be received in the housings of various sizes. Preferably, the slender shape of the lead frames 131 and 132 has an upper width greater than a lower width thereof, and both the upper and lower widths are smaller than or equal to the width of the end opening 116 of the housing 110. When current is supplied from the external power source 230 to the LED strip 120 through the bulb base 150, the current flows into the LED strip 120 via the lead frame 131 and exits the LED strip 120 via the lead frame 132, or, alternatively, flows into the LED strip 120 via the lead frame 132 and exits the LED strip 120 via the lead frame 131. It is understood that the configurations of the lead frames 131 and 132 may be modified in variant embodiments of the present invention. For instance, the lead frames 131 and 132 may be curved or bent, solid or hollow.

Figure 4:
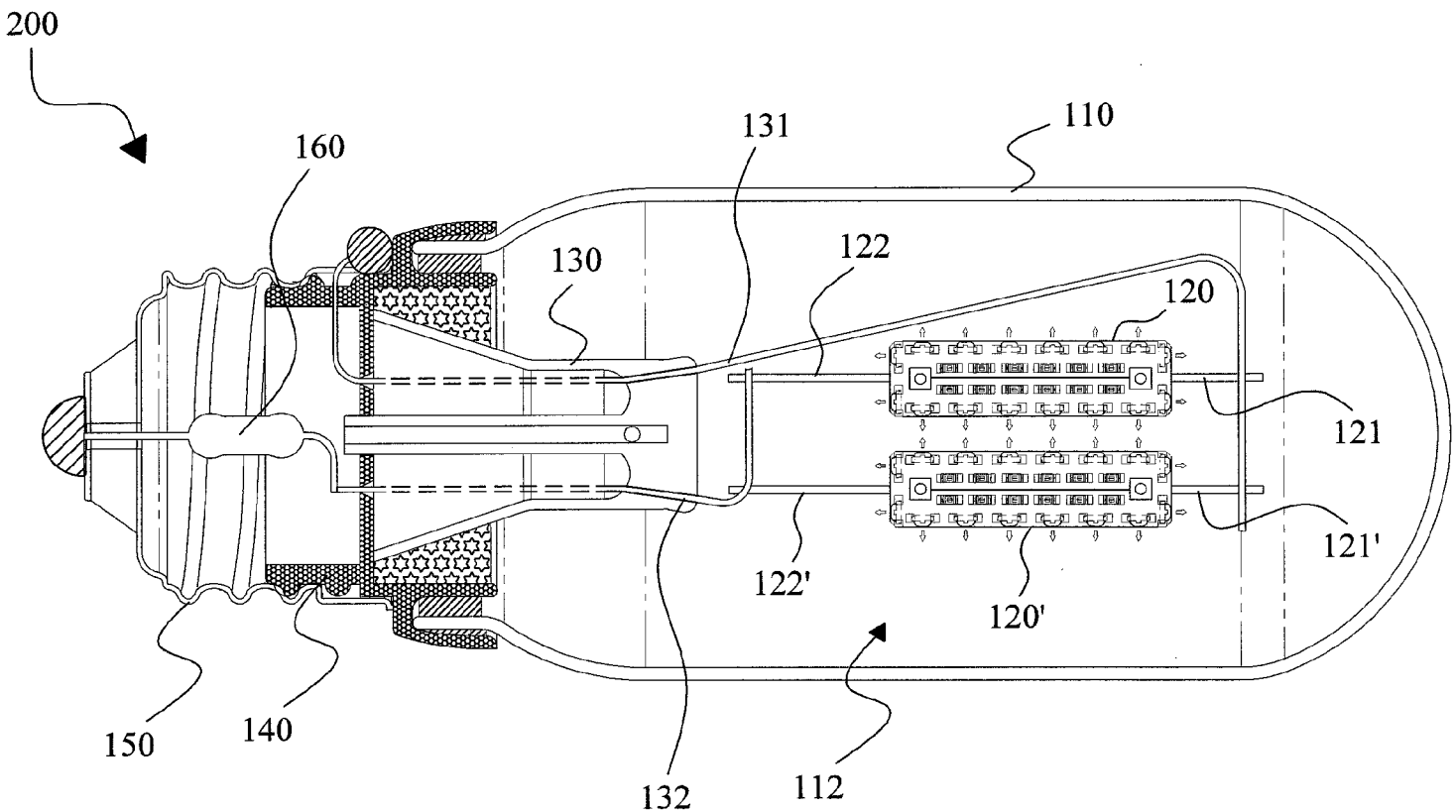
FIG. 4 shows an LED bulb according to a second embodiment of the present invention.

More LED strips 120 may be used in different embodiments according to practical demands enhancing the applications of the LED bulb 100. As shown in FIG. 4 for another embodiment of the present invention, an LED bulb 200 includes two LED strips 120 and 120' adjacent to each other and both electrically connected to the lead frames 131 and 132 by their electrodes 121, 122 and 121', 122'. It is understood that, in a variant embodiment of the present invention, there may be more than two LED strips supported in the cavity 112 by the stem 130 so as to increase the brightness of an LED bulb. In this embodiment, the LED strips 120 and 120' may be suspended between the lead frames 131 and 132 in a face-to-face manner or in a side-by-side manner. In an embodiment, the electrodes 121, 122, and 121', 122' of the LED strips 120, 120' are electrically connected to the lead frames 131, 132 of the stem 130 by soldering, gluing with an electrically conductive adhesive, hook engagement, or winding.

Figure 5:
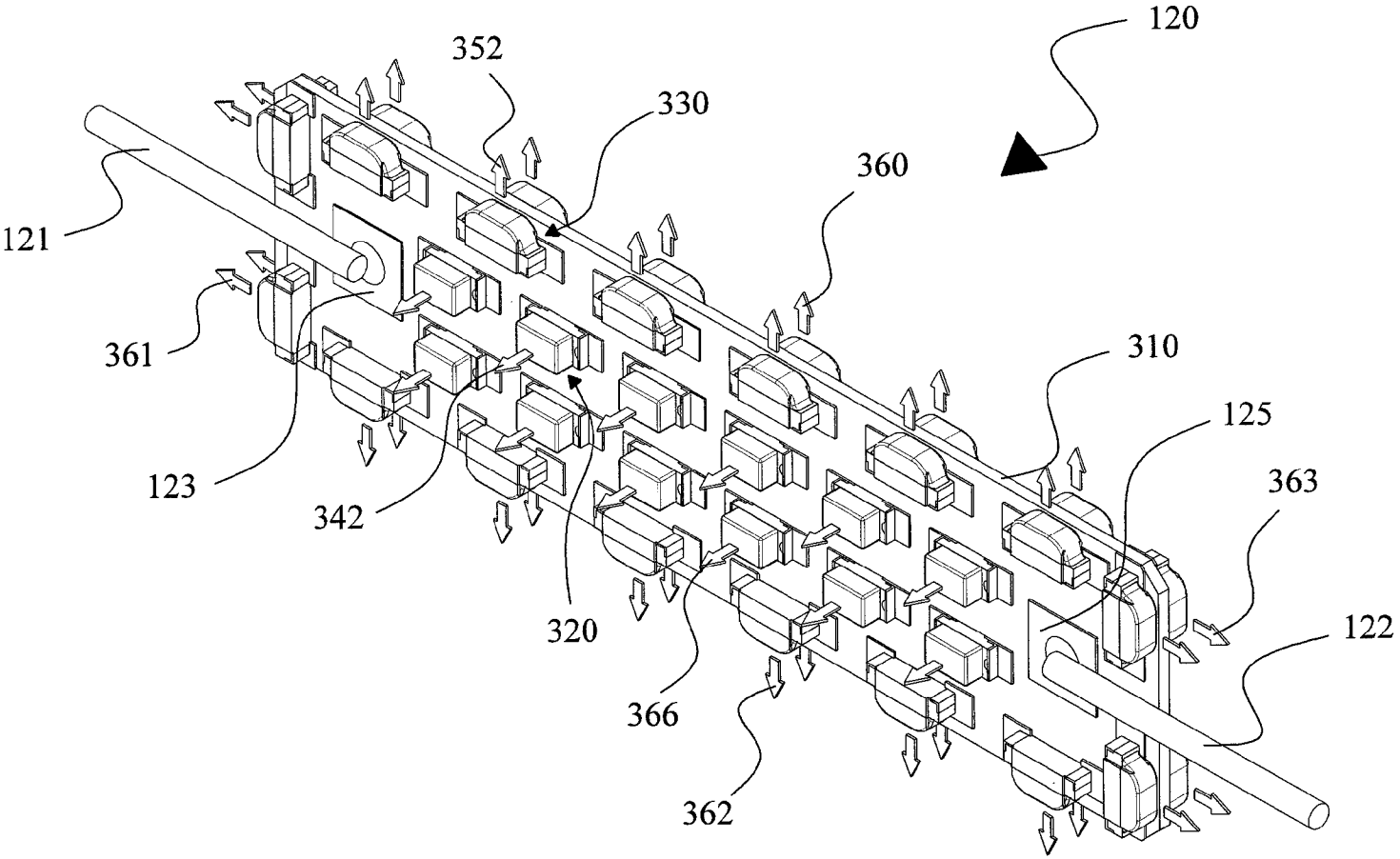
FIG. 5 is a perspective view of a LED strip of the present invention.
Figure 6:
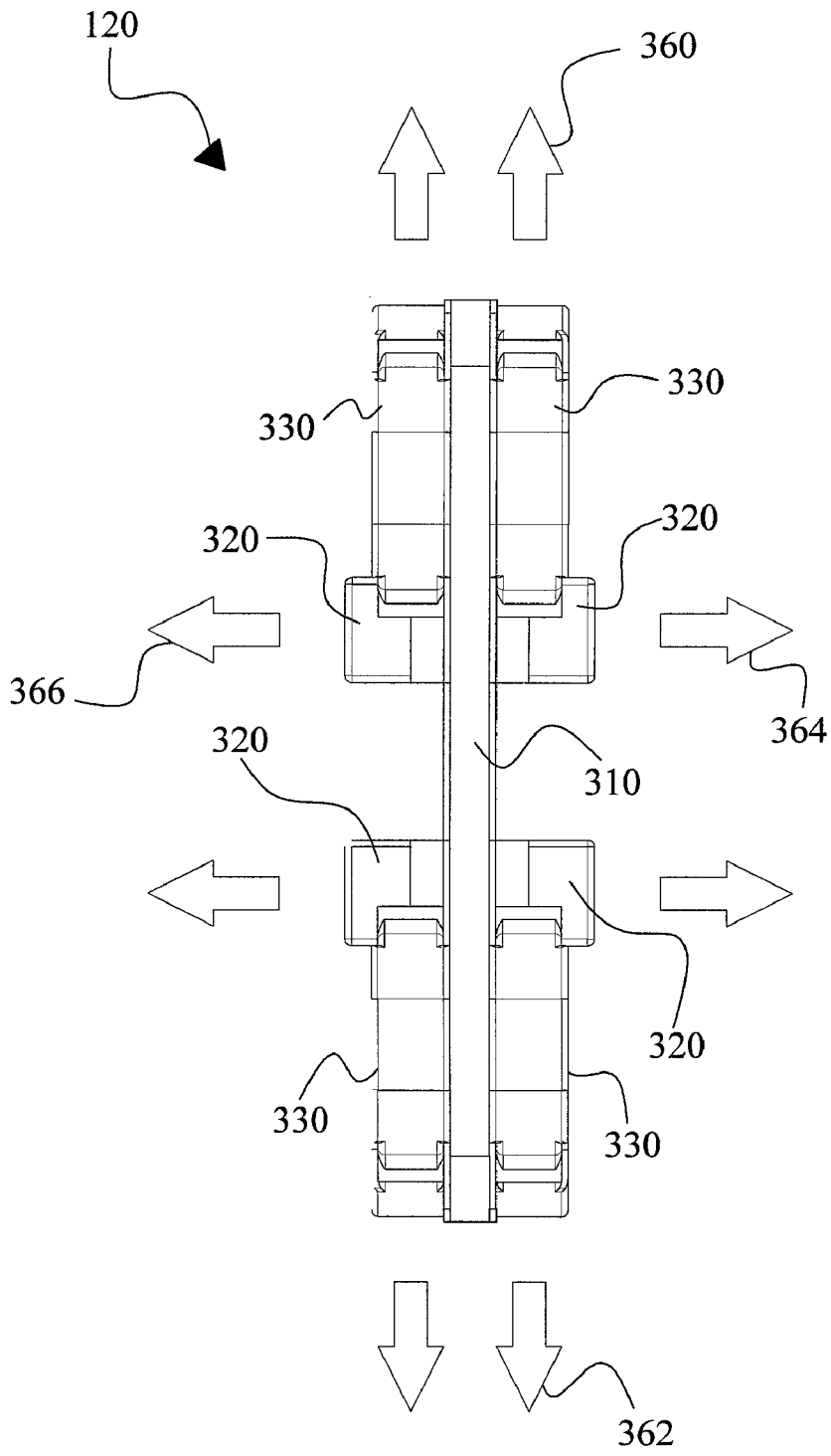
FIG. 6 is a side view of the LED strip as shown in FIG. 5.

FIG. 5 is a perspective view of the LED strip 120, and FIG. 6 is a side-view of the LED strip 120 as shown in FIG. 5. The LED strip 120 includes top-emitting LEDs 320 and side-emitting LEDs 330 mounted on the substrate 310. Each of the top-emitting LEDs 320 has a light-emitting direction perpendicular to the mounting surface of the substrate 310 that it is mounted on, and each of the side-emitting LEDs 330 has a light-emitting direction parallel to the mounting surface of the substrate 310 that it is mounted on. Preferably, the top-emitting LEDs 320 are mounted in the central regions of the opposite mounting surfaces of the substrate 310, and the side-emitting LEDs 330 are mounted in the peripheral regions of the mounting surfaces in a manner surrounding the top-emitting LEDs 320 on the same mounting surfaces, so that the LED strip 120 may provide light emitted by the side-emitting LEDs 330 in multiple lateral directions 360, 361, 362, and 363, and light emitted by the top-emitting LEDs 320 in the forward direction 366 and the backward direction 364. Consequently, the planar LED strip 120 is capable of multi-direction light emission and a wide lighting angle that contribute to extensive and uniform illumination. In this embodiment, the top-emitting LEDs 320 and the side-emitting LEDs 330 both include surface mounted LEDs.

Referring to FIG. 5, in an embodiment, the substrate 310 includes conductors 123 and 125 electrically connected to the electrodes 121 and 122 respectively, to provide power to the top-emitting LEDs 320 and the side-emitting LEDs 330 mounted on the substrate 310. The conductors 123 and 125 include conductive pads, such as metal pads, through which current may flow from the electrode 121 or 122 to the top-emitting LEDs 320 and the side-emitting LEDs 330. In an embodiment, the conductors 123 and 125 are coplanar to a mounting surface of the substrate 310; in another embodiment, the conductors 123 and 125 are on the opposite mounting surfaces of the substrate 310 respectively. The electrodes 121 and 122 may be electrically connected to the conductors 123 and 125 by welding, soldering, gluing with an electrically conductive adhesive, or hook engagement. Current may flow from the electrode 121 to the top-emitting LEDs 320 and the side-emitting LEDs 330 through the conductor 123 and exit the LED strip 120 through the conductor 125 and the electrode 122, or, alternatively, from the electrode 122 to the top-emitting LEDs 320 and the side-emitting LEDs 330 through the conductor 125 and exit the LED strip 120 through the conductor 123 and the electrode 121. Thus, the LED strip 120 is safe and reliable in terms of structure and design.

Figure 7:
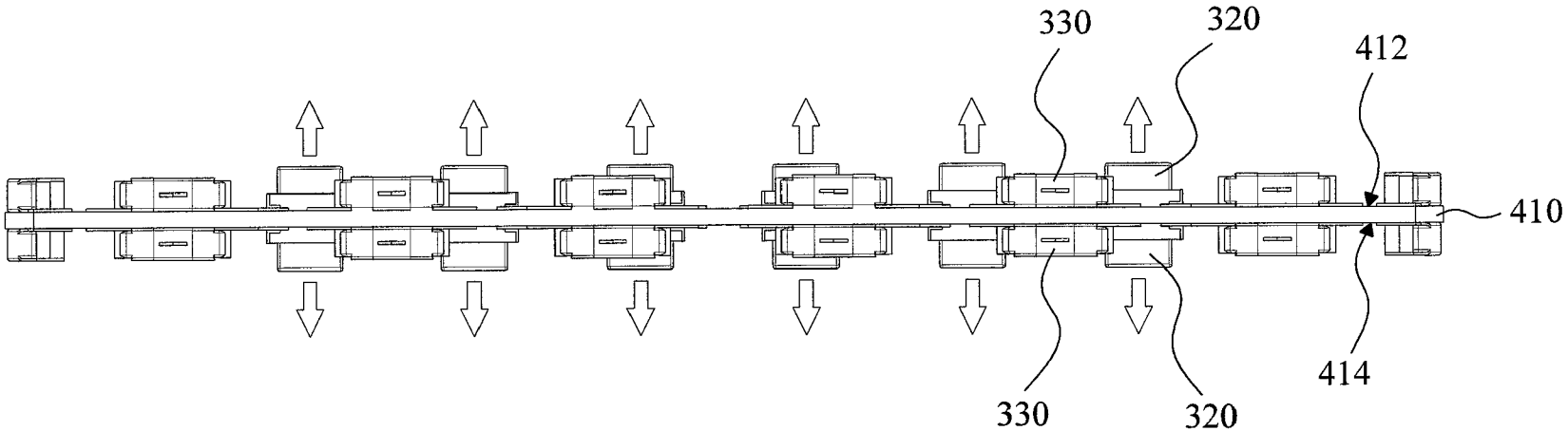
FIG. 7 shows a first embodiment of the LED strip of the present invention.
Figure 8:
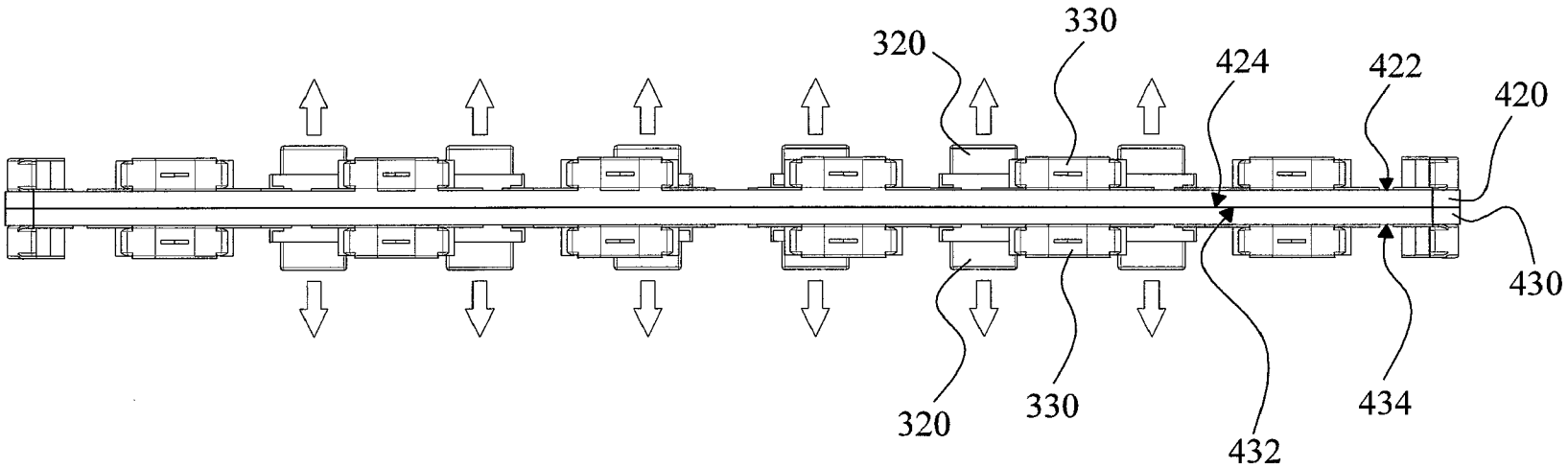
FIG. 8 shows a second embodiment of the LED strip of the present invention.

In an embodiment, as shown in FIG. 7, the substrate 310 includes a double-sided circuit board 410, and the opposite mounting surfaces 412 and 414 thereof are mounted with some of the top-emitting LEDs 320 and some of the side-emitting LEDs 330 respectively. In an embodiment, the top-emitting LEDs 320 and the side-emitting LEDs 330 are divided into two groups, one group of the top-emitting LEDs 320 and the side-emitting LEDs 330 are mounted on the mounting surface 412, and the other group of the top-emitting LEDs 320 and the side-emitting LEDs 330 are mounted on the other mounting surface 414. The double-sided circuit board 410 may be a rigid printed circuit board or a flexible printed circuit board. In another embodiment, as shown in FIG. 8, the substrate 310 includes two single-sided circuit boards 420 and 430 attached to each other in a back-to-back manner. The top-emitting LEDs 320 and the side-emitting LEDs 330 are divided into two groups, one group of the top-emitting LEDs 320 and the side-emitting LEDs 330 are mounted on the mounting surface 422 of the single-sided circuit board 420, and the other group of the top-emitting LEDs 320 and the side-emitting LEDs 330 are mounted on the mounting surface 434 of the single-sided circuit board 430. The backside surface 424 of the single-sided circuit board 420 is attached to the backside surface 432 of the single-sided circuit board 430. The single-sided circuit boards 420, 430 may be rigid printed circuit boards or flexible printed circuit boards. It is understood that, in another embodiment, all the top-emitting LEDs 320 may be mounted on the mounting surface 422 of the single-sided circuit board 420, and all the side-emitting LEDs 330 may be mounted on the mounting surface 434 of the single-sided circuit board 430.

Referring to FIG. 5 again, by mounting the side-emitting LEDs 330 in the peripheral regions of the opposite mounting surfaces of the substrate 310, the LED strip 120 can emit light in multiple lateral directions and thereby provide extensive and uniform illumination. Even if fewer LEDs are used for the LED strip 120, a wide lighting angle is still achievable. Therefore, the dimension of the substrate 310 as well as the number of the top-emitting LEDs 320 and the side-emitting LEDs 330 can be adjusted according to practical demands, so that the LED strip 120 is flexibly applicable to bulbs of different sizes, such as bulbs with standard bulb bases E10, E12, E14, E17, E26, E27, B15, B22, and GU-10. Compared with the conventional LED bulbs using through-hole LEDs as the light source, the LED bulb according to the present invention using the LED strip 120 with surface mounted LEDs or chip-on-board LEDs as its light source has higher structural stability and enhanced safety in current control. As the surface mounted LEDs are available in both the top-emitting type and the side-emitting type, and have higher mounting speed, higher production yield, lower costs, and fewer components than the through-hole LEDs, the LED bulb according to the present invention features multiple light-emitting directions, high assembly speed, high production yield, low costs, and fewer components. Furthermore, if surface mounted LEDs, which are smaller than through-hole LEDs, are used for the LED strip 120, the LED bulb according to the present invention can be made in a variety of dimensions while production costs are also effectively reduced.

Referring to FIGS. 1, 3, and 5, the top-emitting LEDs 320 and the side-emitting LEDs 330 are divided into two lighting groups 210 and 220 that are parallel connected between the lead frames 131 and 132. As shown in FIG. 3, where the external power source 230 is an alternating-current (AC) power source, the lighting group 210 establishes a first circuitry forward biased from the lead frame 131 to the lead frame 132, and the lighting group 220 establishes a second circuitry forward biased from the lead frame 132 to the lead frame 131. Thus, the top-emitting LEDs 320 and the side-emitting LEDs 330 in the lighting group 210 are lit during the positive half cycle of the AC power source 230, and the top-emitting LEDs 320 and the side-emitting LEDs 330 in the lighting group 220 are lit during the negative half cycle of the AC power source 230. As a result, the lighting groups 210, 220 will emit light alternately. In an embodiment, the top-emitting LEDs 320 and the side-emitting LEDs 330 in the lighting group 210 are mounted on one mounting surface of the substrate 310, and the top-emitting LEDs 320 and the side-emitting LEDs 330 in the lighting group 220 are mounted on the opposite mounting surface of the substrate 310, so that the LED strip 120 is capable of alternate light emission from its two mounting surfaces. In another embodiment, the top-emitting LEDs 320 and the side-emitting LEDs 330 in the lighting group 210 are mounted on an upper portion of the substrate 310, and the top-emitting LEDs 320 and the side-emitting LEDs 330 in the lighting group 220 are mounted on a lower portion of the substrate 310, so that the LED strip 120 can emit light from its upper and lower portions by turns. Alternatively, the lighting group 210 includes all the top-emitting LEDs 320 mounted on the substrate 310, and the lighting group 220 includes all the side-emitting LEDs 330 mounted on the substrate 310.

Similarly, as shown in FIGS. 3-5, where the LED bulb 200 includes the LED strips 120 and 120', the top-emitting LEDs 320 and the side-emitting LEDs 330 of the LED strips 120 and 120' may be divided into the lighting groups 210 and 220. In an embodiment, the lighting group 210 includes the top-emitting LEDs 320 and the side-emitting LEDs 330 mounted on the LED strip 120, and the lighting group 220 includes the top-emitting LEDs 320 and the side-emitting LEDs 330 mounted on the LED strip 120', thus allowing the LED strips 120 and 120' to emit light by turns. In another embodiment, the lighting group 210 includes all the top-emitting LEDs 320 of the LED strips 120 and 120', and the lighting group 220 includes all the side-emitting LEDs 330 of the LED strips 120 and 120'.

As shown in the above embodiments, the present invention uses a planar LED strip to achieve the object of increasing the lighting angle of an LED bulb. Compared with the arts using a three-dimensional array of LEDs to achieve the same object, the present invention advantageously employs fewer components, can be assembled more easily, has a higher production yield, and requires lower production costs. In addition, even if a small number of the LEDs fail during use, the LED bulb can still function normally, thus providing high economic benefits.

The lead frames disclosed herein not only support the LED strip, but also supply power from the external power source to the LED strip. Hence, the lead frames of the LED bulb according to the present invention can be formed as their counterparts in standard bulbs so as to be compatible with the shapes of existing glass bulbs and the Edison screw bulb bases. By grouping the LEDs into two opposite polarity directions to be driven by an AC power source directly or under the limitation of the power control unit, there will be no need of power converters, for example AC-to-DC converters, and consequently the reliability and component safety of the LED bulb are increased while the costs of the LED bulb are further reduced.

The foregoing description and disclosure only serve to demonstrate the principle and features of the present invention and are not intended to limit the scope of the present invention, which is defined by the appended claims. It is understood that all equivalent modifications, changes, and combination of the disclosed components should be encompassed by the appended claims. In addition, as the words "a", "an", and "one" used in the description and disclosure of the present invention and the appended claims connote "at least one", changes in the number of the disclosed components should also fall within the scope of the present invention.

What is claimed is:

1. An LED bulb, comprising:

a bulb base;

a housing having a cavity and an end opening;

a stem having a first lead frame and a second lead frame extending into the cavity and electrically connected to the bulb base;

a member joined to the bulb base and the housing; and at least one LED strip suspended between the first and second lead frames and having a first electrode and a second electrode electrically connected to the first and second lead frames respectively, wherein each of the at least one LED strip comprises:

a substrate;

a plurality of top-emitting LEDs mounted on the substrate, having a light-emitting direction substantially perpendicular to the substrate; and a plurality of side-emitting LEDs mounted on the substrate, having a light-emitting direction substantially parallel to the substrate.

2. The LED bulb of claim 1, wherein the side-emitting LEDs are mounted on the substrate of the at least one LED strip in a manner surrounding the top-emitting LEDs mounted thereon.

3. The LED bulb of claim 2, wherein the side-emitting LEDs are mounted in a peripheral region of a mounting surface of the substrate so as to emit light in multiple directions substantially parallel to the mounting surface of the substrate.

4. The LED bulb of claim 1, wherein the substrate comprises a double-sided circuit board having a first mounting surface with a first group of the top-emitting and side-emitting LEDs, and a second mounting surface opposite to the first mounting surface and with a second group of the top-emitting and side-emitting LEDs.

5. The LED bulb of claim 1, wherein the substrate comprises:

a first single-sided circuit board having a first mounting surface with a first group of the top-emitting and side-emitting LEDs; and a second single-sided circuit board having a second mounting surface with a second group of the top-emitting and side-emitting LEDs;

wherein the first and second single-sided circuit boards are attached to each other in a back-to-back manner.

6. The LED bulb of claim 1, wherein the substrate comprises a first conductor and a second conductor electrically connected to the first and second electrodes of the at least one LED strip respectively, to provide power to the top-emitting LEDs and the side-emitting LEDs mounted thereon.

7. The LED bulb of claim 6, wherein the first and second conductors are coplanar to a mounting surface of the substrate.

8. The LED bulb of claim 6, wherein the first and second conductors are on a first mounting surface and a second mounting surface opposite to the first mounting surface of the substrate respectively.

9. The LED bulb of claim 1, wherein the top-emitting LEDs and the side-emitting LEDs comprise:

a first lighting group having a first circuitry forward biased from the first lead frame to the second lead frame in response to a positive half cycle of a power source electrically connected thereto via the bulb base; and a second lighting group having a second circuitry forward biased from the second lead frame to the first lead frame in response to a negative cycle of the power source electrically connected thereto via the bulb base.

10. The LED bulb of claim 9, wherein the first and second lighting groups of the top-emitting LEDs and side-emitting LEDs are on opposite mounting surfaces of the substrate respectively.

11. The LED bulb of claim 9, wherein the first and second lighting groups of the top-emitting LEDs and side-emitting LEDs are on an upper potion and a lower portion of the substrate respectively.

12. The LED bulb of claim 1, wherein the at least one LED strip comprises more than two LED strips suspended between the first and second lead frames of the stem.

13. The LED bulb of claim 1, wherein the first and second lead frames of the stem are of a slender shape having an upper width greater than a lower width thereof, and both the upper and lower widths are smaller than or equal to a width of the end opening of the housing.

14. The LED bulb of claim 1, wherein the first lead frame of the stem extends into the cavity of the housing away from the second lead frame of the stem at a distance greater than or equal to a length of the substrate of the at least one LED strip.

15. The LED bulb of claim 1, further comprising a power control unit electrically connected between the bulb base and the second lead frame of the stem.

* * * * *